US011951547B2

(12) United States Patent
Bando et al.

(10) Patent No.: US 11,951,547 B2
(45) Date of Patent: Apr. 9, 2024

(54) VALVE GUIDE MADE OF IRON-BASED SINTERED ALLOY AND METHOD OF PRODUCING SAME

(71) Applicant: TPR CO., LTD., Tokyo (JP)

(72) Inventors: Yoshio Bando, Tokyo (JP); Fumiya Ito, Tokyo (JP); Kenichi Harashina, Tokyo (JP)

(73) Assignee: TPR CO., LTD., Tokyo (JP)

( * ) Notice: Subject to any disclaimer, the term of this patent is extended or adjusted under 35 U.S.C. 154(b) by 0 days.

(21) Appl. No.: 16/627,682

(22) PCT Filed: Oct. 23, 2018

(86) PCT No.: PCT/JP2018/039328
§ 371 (c)(1),
(2) Date: Dec. 30, 2019

(87) PCT Pub. No.: WO2019/087863
PCT Pub. Date: May 9, 2019

(65) Prior Publication Data

US 2020/0165945 A1 May 28, 2020

(30) Foreign Application Priority Data

Oct. 30, 2017 (JP) ..... 2017-209189

(51) Int. Cl.
*B22F 5/00* (2006.01)
*B22F 3/16* (2006.01)
(Continued)

(52) U.S. Cl.
CPC ..... *B22F 5/008* (2013.01); *B22F 3/16* (2013.01); *C22C 38/16* (2013.01); *F01L 3/08* (2013.01);
(Continued)

(58) Field of Classification Search
CPC ..... F01L 3/08; F01L 2301/00; F01L 2303/00; B22F 2998/10; B22F 1/0003; B22F 1/025;
(Continued)

(56) References Cited

U.S. PATENT DOCUMENTS 4,011,077 A 3/1977 Kaufman
5,631,431 A * 5/1997 Andersson ..... C22C 33/0228 75/230
(Continued)

FOREIGN PATENT DOCUMENTS

CN 1488006 A 4/2004
CN 101772389 A 7/2010
(Continued)

OTHER PUBLICATIONS

Ramakrishnan, P. "Automotive applications of powder metallurgy." 2013. Indian institute of Technology. Woodhead publishing. p. 493-519. (Year: 2013).*
(Continued)

*Primary Examiner* — Nicholas A Wang
(74) *Attorney, Agent, or Firm* — Merchant & Gould P.C.

(57) ABSTRACT

Provided are a valve guide made of an iron-based sintered alloy excellent in wear resistance and thermal conductivity, and a method of producing the same. Specifically, provided are a method of producing a valve guide made of an iron-based sintered alloy, the method including the steps of: molding raw material powder including diffusion-alloyed powder including core iron powder and Cu bonded to the core iron powder through diffusion to obtain a molded body; and sintering the molded body, to thereby produce a valve guide made of an iron-based sintered alloy, and a valve guide produced by the production method.

6 Claims, 5 Drawing Sheets

(51) Int. Cl.
*C22C 38/16* (2006.01)
*F01L 3/08* (2006.01)

(52) U.S. Cl.
CPC ..... *B22F 2301/10* (2013.01); *B22F 2301/35* (2013.01); *F01L 2301/00* (2020.05); *F01L 2303/00* (2020.05)

(58) Field of Classification Search
CPC ..... B22F 3/02; B22F 3/10; B22F 1/02; B22F 2301/10; B22F 2301/35; B22F 3/1035; B22F 3/16; B22F 5/008; B22F 5/10; C22C 33/0278; C22C 38/16
See application file for complete search history.

(56) References Cited

U.S. PATENT DOCUMENTS

| | | | | |
|---|---|---|---|---|
| 6,632,263 | B1 * | 10/2003 | Nigarura | C22C 38/12 75/231 |
| 2004/0112173 | A1 | 6/2004 | Maulik | |
| 2004/0131492 | A1 | 7/2004 | Kawakami et al. | |
| 2005/0040358 | A1 | 2/2005 | Chikahata et al. | |
| 2006/0032328 | A1 | 2/2006 | Chikahata et al. | |
| 2006/0099079 | A1 | 5/2006 | Kawase et al. | |
| 2006/0198752 | A1 * | 9/2006 | Kawase | B22F 3/1003 419/14 |
| 2011/0146448 | A1 | 6/2011 | Fujitsuka et al. | |
| 2012/0177528 | A1 * | 7/2012 | Takayama | F16C 33/14 228/199 |
| 2013/0084203 | A1 | 4/2013 | Fukae et al. | |
| 2015/0285300 | A1 * | 10/2015 | Ito | B22F 5/10 384/279 |
| 2015/0322828 | A1 | 11/2015 | Kohler et al. | |
| 2016/0160700 | A1 | 6/2016 | Takahashi | |
| 2017/0259340 | A1 | 9/2017 | Takashita et al. | |
| 2017/0298790 | A1 | 10/2017 | Kohler et al. | |
| 2018/0056394 | A1 | 3/2018 | Yashiro et al. | |
| 2018/0193911 | A1 | 7/2018 | Kobayashi et al. | |
| 2019/0055986 | A1 | 2/2019 | Komatsubara et al. | |

FOREIGN PATENT DOCUMENTS

| | | | |
|---|---|---|---|
| CN | 101775521 | A | 7/2010 |
| CN | 101786166 | A | 7/2010 |
| CN | 102921941 | A | 2/2013 |
| CN | 103882325 | A | 6/2014 |
| CN | 103898416 | A | 7/2014 |
| CN | 104073722 | A | 10/2014 |
| CN | 104428500 | A | 3/2015 |
| CN | 104907554 | * | 9/2015 |
| CN | 105263653 | A | 1/2016 |
| CN | 105695872 | A | 6/2016 |
| CN | 107000052 | A | 8/2017 |
| EP | 1370704 | A1 | 12/2003 |
| GB | 2023184 | B | 10/1982 |
| GB | 2429464 | A | 2/2007 |
| JP | 51-149107 | A | 12/1976 |
| JP | 6-066117 | A | 3/1994 |
| JP | H06-66117 | A | 3/1994 |
| JP | 11-323512 | A | 11/1999 |
| JP | 2002-069599 | A | 3/2002 |
| JP | 5658804 | B | 1/2015 |
| JP | 2015-25169 | A | 2/2015 |
| JP | 2017-150596 | A | 8/2017 |
| KR | 10-2004-0030358 | A | 4/2004 |
| KR | 20050088353 | A | 9/2005 |
| KR | 10-2006-0050208 | A | 5/2006 |
| KR | 10-2011-0073291 | A | 6/2011 |
| KR | 10-2013-0035912 | A | 4/2013 |
| WO | 02/059388 | A1 | 8/2002 |
| WO | 2009/113821 | A2 | 9/2009 |
| WO | 2015/012249 | A1 | 1/2015 |
| WO | 2016/148137 | A1 | 9/2016 |
| WO | 2017/043094 | A1 | 3/2017 |

OTHER PUBLICATIONS

"Graphite powder". American Elements. 2016. wayback machine: http://web.archive.org/web/20160420195155/https://www.americanelements.com/graphite-powder-7782-42-5 (Year: 2016).*
International Search Report and Written Opinion for PCT/JP2018/039328, dated Dec. 25, 2018.
Office Action for Japanese Patent Application No. 2018-555692, dated Jan. 8, 2019.
Decision to Grant a Patent for Japanese Patent Application No. 2018-555692, dated Mar. 19, 2019.
Office Action for Chinese Patent Application No. 201880047375.X, dated Sep. 3, 2020.
Communication pursuant to Article 94(3) for European Patent Application No. 18872685.5, dated Nov. 2, 2020.
Office Action for Korean Patent Application No. 10-2020-7000579, dated Apr. 28, 2020.
Office Action for Chinese Patent Application No. 201880047375.X, dated May 8, 2020.
Search Report for European Patent Application No. 18872685.5, dated Apr. 14, 2020.
Communication pursuant to Article 94(3) EPC for European Patent Application No. 18872685.5, dated Jun. 1, 2021.
Office Action for Indian Patent Application No. 201927054775, dated Mar. 31, 2021.
Office Action for Corresponding Brazilian Patent Application No. BR112020002233-0 dated Jul. 17, 2022. (4 pages).
Office Action for Brazilian Patent Application No. 11 2020 002233-0 (dated Nov. 25, 2022).

* cited by examiner

50 μm ELECTRON MICROGRAPH1

50 μm SYNTHETIC

VALVE GUIDE MADE OF IRON-BASED SINTERED ALLOY AND METHOD OF PRODUCING SAME

CROSS REFERENCE TO RELATED APPLICATIONS

This application is a U.S. National Stage of International Patent Application No. PCT/JP2018/039328, filed Oct. 23, 2018, which claims benefit of Japanese Patent Application No. 2017-209189, filed Oct. 30, 2017, and which applications are incorporated herein by reference. To the extent appropriate, a claim of priority is made to each of the above disclosed applications.

TECHNICAL FIELD

The present invention relates to a valve guide made of an iron-based sintered alloy and a method of producing the same.

BACKGROUND

In recent gasoline engines for automobiles, combustion efficiency has been improved by combining various technologies, such as downsizing, and direct injection and turbocharging, with intent to achieve low fuel consumption, low emission, and high output. The combustion efficiency has been improved by reducing various losses, and in particular, an exhaust loss having a high loss rate has attracted attention. As a technology for reducing the exhaust loss, high compression has been attempted. The high compression inevitably brings about an increase in temperature of an engine and entails a risk of the occurrence of abnormal combustion, such as knocking, and hence a measure to cool a combustion chamber is required. Particularly around an exhaust-side valve having a high ambient temperature, improvement in cooling is essential, and also a valve guide, which is responsible for a valve cooling function, is required to have a high valve cooling capacity.

As a valve guide material having a high valve cooling capacity, there is given, for example, a valve guide made of brass. However, the valve guide made of brass has problems in that its wear resistance is insufficient because the number of pores each having an oil retention property is small, and cost, such as processing cost, is also high as compared to the case of a valve guide made of an iron-based sintered alloy, which has hitherto been used. Therefore, there is proposed a technology for improving the valve cooling capacity and wear resistance of a valve guide made of a sintered alloy, which has lower cost than the valve guide made of brass (Patent Literatures 1 and 2).

For example, in Patent Literature 1, there is proposed a valve guide made of a sintered alloy which has a composition including, in terms of mass %, 10% to 90% of Cu, 0% to 10% of Cr, 0% to 6% of Mo, 0% to 8% of V, 0% to 8% of W, and 0.5% to 3% of C, with the balance being Fe and inevitable impurities and having a total content of Cr, Mo, V, and W of 2% or more and 16% or less, and which has a structure including an Fe-based alloy phase containing Fe as a main component, a Cu phase or a Cu-based alloy phase containing Cu as a main component, and a graphite phase. In addition, in Patent Literature 2, there is proposed a valve guide made of a sintered alloy formed of a sintered material in which iron-based alloy powder and copper-based alloy powder including 26 wt % to 30 wt % of Ni are mixed at a blending ratio in terms of weight of from 4:6 to 6:4.

CITATION LIST

Patent Literature

[PTL 1] JP 5658804 B1
[PTL 2] JP 06-66117 A

SUMMARY OF INVENTION

Technical Problem

The present invention has been made in view of the above-mentioned circumstances, and an object of the present invention is to provide a valve guide made of an iron-based sintered alloy excellent in wear resistance and thermal conductivity, and a method of producing the same.

Solution to Problem

The above-mentioned object is achieved by the following aspects of the present invention.

That is, according to one aspect of the present invention, there is provided a method of producing a valve guide made of an iron-based sintered alloy, the method including the steps of: molding raw material powder including diffusion-alloyed powder including core iron powder and Cu bonded to the core iron powder through diffusion to obtain a molded body; and sintering the molded body, to thereby produce a valve guide made of an iron-based sintered alloy.

According to one embodiment of the present invention, in the method of producing a valve guide made of an iron-based sintered alloy, it is preferred that: (1) the raw material powder have a content of a Cu component falling within a range of from 14 mass % to 40 mass %; and (2) a ratio of a Cu component derived from the diffusion-alloyed powder including core iron powder and Cu bonded to the core iron powder through diffusion with respect to the Cu component contained in the raw material powder be 45% or more.

According to another embodiment of the present invention, in the method of producing a valve guide made of an iron-based sintered alloy, it is preferred that the raw material powder include C powder and a solid lubricant.

According to another embodiment of the present invention, in the method of producing a valve guide made of an iron-based sintered alloy, it is preferred that a sintering temperature in the sintering step fall within a range of from 1,102° C. to 1,152° C.

According to another embodiment of the present invention, in the method of producing a valve guide made of an iron-based sintered alloy, it is preferred that a sintering time period in the sintering step fall within a range of from 10 minutes to 2 hours.

According to a first aspect of the present invention, there is provided a valve guide made of an iron-based sintered alloy, which is produced through the steps of: molding raw material powder including diffusion-alloyed powder including core iron powder and Cu bonded to the core iron powder through diffusion to obtain a molded body; and sintering the molded body.

According to one embodiment of the first aspect of the present invention, in the valve guide made of an iron-based sintered alloy, it is preferred that: (1) the raw material powder have a content of a Cu component falling within a range of from 14 mass % to 40 mass %; and (2) a ratio of a Cu component derived from the diffusion-alloyed powder including core iron powder and Cu bonded to the core iron powder through diffusion with respect to the Cu component contained in the raw material powder be 45% or more.

According to a second aspect of the present invention, there is provided a valve guide made of an iron-based sintered alloy, including 10 mass % to 40 mass % of Cu, having a structure including pores and a Cu phase, and having a pore area ratio of the pores of 3% or more and a Cu area ratio of the Cu phase of from 11% to 36%.

According to one embodiment of the first aspect and the second aspect of the present invention, it is preferred that the valve guide made of an iron-based sintered alloy include 12 mass % to 35 mass % of Cu.

According to another embodiment of the first aspect and the second aspect of the present invention, it is preferred that the valve guide made of an iron-based sintered alloy include 20 mass % to 30 mass % of Cu.

According to another embodiment of the first aspect and the second aspect of the present invention, it is preferred that the valve guide made of an iron-based sintered alloy have a Cu area ratio of from 13.1% to 33.8%.

According to another embodiment of the first aspect and the second aspect of the present invention, it is preferred that the valve guide made of an iron-based sintered alloy have a Cu area ratio of from 17% to 29%.

According to another embodiment of the first aspect and the second aspect of the present invention, it is preferred that the valve guide made of an iron-based sintered alloy have a pore area ratio of 3.6% or more.

According to another embodiment of the first aspect and the second aspect of the present invention, it is preferred that the valve guide made of an iron-based sintered alloy have a pore area ratio of 7.3% or more.

According to another embodiment of the first aspect and the second aspect of the present invention, it is preferred that the valve guide made of an iron-based sintered alloy have a pore area ratio of 15% or less.

Advantageous Effects of Invention

According to the present invention, the valve guide made of an iron-based sintered alloy excellent in wear resistance and thermal conductivity, and the method of producing the same can be provided.

BRIEF DESCRIPTION OF DRAWINGS

FIG. 7A is an electron micrograph for showing an appearance configuration of the Cu partially diffusion-alloyed powder, and FIG. 7(B) is a composition map for showing distribution of Cu on a surface of the Cu partially diffusion-alloyed powder shown in FIG. 7A.

FIG. 8A is an electron micrograph of Experimental Example A3, FIG. 8B is an electron micrograph of Experimental Example B3, FIG. 8C is a composition image of an Fe element in Experimental Example A3, FIG. 8D is a composition image of an Fe element in Experimental Example B3, FIG. 8E is a composition image of a Cu element in Experimental Example A3, and FIG. 8F is a composition image of a Cu element in Experimental Example B3.

DESCRIPTION OF EMBODIMENTS

Figure 1:
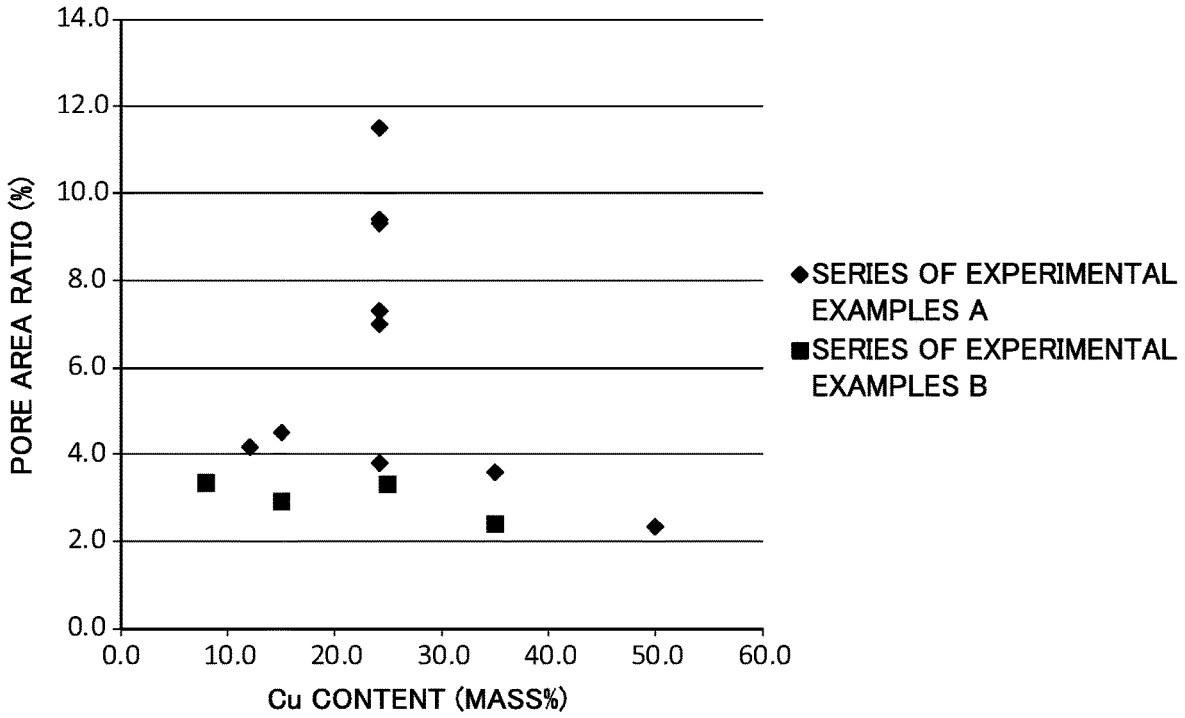
FIG. 1 is a graph for showing a change in pore area ratio (%) with respect to a Cu content (mass %).

A method of producing a valve guide made of an iron-based sintered alloy (hereinafter sometimes abbreviated as "valve guide") according to an embodiment of the present invention includes the steps of: molding raw material powder including diffusion-alloyed powder including core iron powder and Cu bonded to the core iron powder through diffusion (hereinafter sometimes referred to as "Cu partially diffusion-alloyed powder") to obtain a molded body; and sintering the molded body. In this case, a Cu content in the Cu partially diffusion-alloyed powder is not particularly limited, but is preferably from 8 mass % to 45 mass %, preferably from 10 mass % to 30 mass %, particularly preferably 25 mass %±2 mass %. As the Cu partially diffusion-alloyed powder, for example, Cu partially diffusion-alloyed powder having a Cu content of 25 mass % or Cu partially diffusion-alloyed powder having a Cu content of about 10 mass % may be used.

In the raw material powder, C powder and a solid lubricant are preferably used in addition to the Cu partially diffusion-alloyed powder, and a lubricant used at the time of forming the molded body with a mold is more preferably incorporated. The solid lubricant is not particularly limited, and any known solid lubricant may be utilized. An example thereof may be $MoS_2$. In addition, a mold release agent is not particularly limited, and any known mold release agent may be utilized. An example thereof may be zinc stearate. In addition, the Cu partially diffusion-alloyed powder is used as a main supply source for a Fe component and a Cu component in the raw material powder, but in order to adjust a Cu content in the valve guide to a desired value, Fe powder, Fe-based alloy powder, Cu powder, or Cu-based alloy powder may also be used in combination as required. In addition, other than the above-mentioned powders, powder containing, as a main component, another metal element, a non-metal element, or a compound (e.g., an oxide, a carbide, a carbonate, or an alloy) containing each of these elements may also be used in combination. Examples of the powder containing such element as a main component include powders containing Ca, Zn, Ni, Cr, V, W, and the like as main components.

The raw material powder obtained by mixing the component powders is filled into a mold, and compressed under pressure with a forming press or the like. Thus, the molded body is obtained. The density of the molded body may be set to, for example, from about 6.55 g/cm$^3$ to about 7.15 g/cm$^3$. Next, the molded body is subjected to degreasing treatment as required, and is then sintered within a temperature range above the melting point of Cu (1,085° C.), for example, within a range of from 1,102° C. to 1,152° C. An atmosphere at the time of sintering may be a vacuum atmosphere or an atmosphere of a non-oxidizing gas, such as a nitrogen gas. At this time, a sintering time period is preferably from 10 minutes to 2 hours, more preferably from 15 minutes to 1 hour, still more preferably from 20 minutes to 40 minutes. Moreover, the molded body after the sintering is subjected to cutting work or the like. Thus, a valve guide having a predetermined shape is obtained.

In the method of producing a valve guide according to this embodiment, it is preferred that: (1) the raw material powder have a content of a Cu component falling within a range of from 14 mass % to 40 mass %; and (2) a ratio of a Cu component derived from the Cu partially diffusion-alloyed powder with respect to the Cu component contained in the raw material powder be 45% or more. In this case, the valve guide can be significantly improved in wear resistance while ensuring comparable thermal conductivity as compared to a valve guide produced by using only Fe powder and Cu powder as supply sources for the Fe component and the Cu component in the raw material powder, respectively.

When (1) the raw material powder has a content of a Cu component of 14 mass % or more, and (2) the ratio of a Cu component derived from the Cu partially diffusion-alloyed powder with respect to the Cu component contained in the raw material powder is 45% or more, the degree of improvement in wear resistance is easily increased as compared to the case of the valve guide produced by using only Fe powder and Cu powder as supply sources for the Fe component and the Cu component in the raw material powder, respectively. In addition, while absolute wear resistance tends to be reduced more as (1) the raw material powder has a higher content of the Cu component, when the content of the Cu component is 40 mass % or less, wear resistance at a practical level is easily ensured.

In addition, when (2) the ratio of the Cu component derived from the Cu partially diffusion-alloyed powder with respect to the Cu component contained in the raw material powder is 45% or more, Cu can be dispersed more uniformly in a matrix as compared to the case of the valve guide produced by using only Fe powder and Cu powder as supply sources for the Fe component and the Cu component in the raw material powder, respectively, and as a result, the wear resistance is more easily improved.

Herein, (1) the content of the Cu component in the raw material powder is more preferably from 20 mass % to 40 mass %, still more preferably from 23 mass % to 37 mass %. In addition, (2) the ratio of the Cu component derived from the Cu partially diffusion-alloyed powder with respect to the Cu component contained in the raw material powder is preferably 50% or more, more preferably 56% or more, still more preferably 80% or more, particularly preferably 100%. Even when the blending ratio of the Cu partially diffusion-alloyed powder in the raw material powder is set to 55 mass % or more as an alternative condition to the condition (2) to be combined with the condition (1), the same effects as in the case of combining the conditions (1) and (2) can be exhibited. In this case, the blending ratio of the Cu partially diffusion-alloyed powder in the raw material powder is preferably 80 mass % or more, more preferably 90 mass % or more.

Next, a valve guide according to an embodiment of the present invention is described.

A valve guide according to a first embodiment of the present invention has a feature in that the valve guide is produced by utilizing the method of producing a valve guide according to the above-mentioned embodiment of the present invention. With this, a valve guide having comparable or higher performance in terms of wear resistance and thermal conductivity as compared to a valve guide produced by the related-art method of producing a valve guide can be provided. In particular, when (1) the raw material powder has a content of a Cu component falling within a range of from 14 mass % to 40 mass %, and (2) the ratio of the Cu component derived from the Cu partially diffusion-alloyed powder with respect to the Cu component contained in the raw material powder is 45% or more, the valve guide can be significantly improved in wear resistance while ensuring comparable thermal conductivity as compared to a valve guide produced by using only Fe powder and Cu powder as supply sources for the Fe component and the Cu component in the raw material powder, respectively.

In addition, it is preferred that the valve guide according to the first embodiment of the present invention include 10 mass % to 40 mass % of Cu, have a structure including pores and a Cu phase, and have a pore area ratio of the pores of 3% or more and a Cu area ratio of the Cu phase of from 11% to 36%.

When the Cu content is 10 mass % or more, and the Cu area ratio is 11% or more, additionally excellent thermal conductivity is easily obtained. In addition, when the Cu content is 40 mass % or less, and the Cu area ratio is 36% or less, the pore area ratio of 3% or more is easily obtained. In addition, when the pore area ratio is 3% or more, the valve guide can ensure a sufficient oil retention property, and hence easily achieves excellent wear resistance. In this case, the valve guide has excellent thermal conductivity, and hence is suppressed in increase in temperature, and thus has a high valve cooling capacity. As a result, heat dissipation from a valve is promoted, and an increase in temperature of the valve can be suppressed. This enables suppression of wear of the valve, and can contribute to reduction in engine abnormal combustion, such as knocking.

In the valve guide according to the first embodiment of the present invention, a thermal conductivity at 400° C. can be controlled to fall within a range of from about 28 W/m·K to about 60 W/m·K by mainly selecting the Cu content and the Cu area ratio. From the viewpoint of the valve cooling capacity, the thermal conductivity is preferably from 40 W/m·K to 60 W/m·K, more preferably from 50 W/m·K to 60 W/m·K, and from the viewpoint of satisfactorily balancing the valve cooling capacity and other characteristics, is still more preferably from 50 W/m·K to 55 W/m·K.

When the Cu content is 40 mass % or less, also production cost is easily reduced. The Cu content is preferably more than 10 mass % and 40 mass % or less, more preferably from 12 mass % to 35 mass %, still more preferably from 20 mass % to 30 mass %, particularly preferably from 23 mass % to 27 mass %.

In addition, the Cu area ratio is preferably from 13.1% to 33.8%, more preferably from 17% to 29%.

In addition, the pore area ratio is preferably 3.6% or more, more preferably 7.3% or more. The upper limit value of the pore area ratio is not particularly limited, but from the viewpoint of ensuring the strength of the valve guide, is preferably 15% or less, more preferably 12% or less, still more preferably 11.5% or less. With this, the valve guide can be prevented from escaping from a cylinder block after the valve guide is pressed into the cylinder block.

While the valve guide according to the first embodiment of the present invention has a composition including at least Cu, Fe, and inevitable impurities, a metal element other than Cu and Fe and a non-metal element may be further incorporated therein. Examples of such elements may include C, Mo, S, Ca, Zn, Ni, Cr, V, and W, and the kind and content of the element may be appropriately selected as required. However, it is known that Ni forms an all proportional solid solution with Cu, and hence the thermal conductivity is remarkably reduced owing to the formation of the solid solution of Ni with Cu (for example, paragraph 0015 of Patent Literature 1). That is, Ni inhibits an increase in thermal conductivity, and hence it is preferred that the valve guide of this embodiment be free of Ni.

In addition, Cr, Mo, V, and W cause an increase in cost. Therefore, it is preferred that the valve guide of this embodiment be basically free of Cr, Mo, V, and W, or have extremely small contents of these elements. However, of those elements, it is preferred to use Mo in a small amount in the valve guide of this embodiment from the viewpoint of improving the wear resistance and processability.

C is an element which strengthens an iron base material of a sintered body to increase strength and hardness, but when C is included in an excess amount, cementite is liable to be formed in the base material. Therefore, when C is used, a C content is preferably from 0.8 mass % to 1.2 mass %. In addition, as a mold release agent at the time of molding, for example, zinc stearate may be used. The other metal elements listed above may each be included in a matrix in the form of a sulfide (e.g., $MoS_2$) or a carbonate, other than a metal.

A valve guide according to a second embodiment of the present invention has features of including 10 mass % to 40 mass % of Cu, having a structure including pores and a Cu phase, and having a pore area ratio of the pores of 3% or more and a Cu area ratio of the Cu phase of from 11% to 36%. Other configurations of the valve guide according to the second embodiment of the present invention may be the same as in the valve guide according to the first embodiment of the present invention. In addition, the valve guide according to the second embodiment of the present invention may be produced by the method of producing a valve guide according to the above-mentioned embodiment of the present invention, but may be produced by any other production method.

The valve guides according to the first and second embodiments of the present invention may each be utilized as a valve guide for an intake valve or a valve guide for an exhaust valve of an internal combustion engine, but are each preferably used as the valve guide for an exhaust valve.

EXAMPLES

Now, the present invention is described by way of Experimental Examples, but the present invention is not limited only to the following Experimental Examples.

1. Production of Valve Guide

For producing each of valve guides of Experimental Examples, powders listed below were appropriately combined and used as raw material powder. The particle diameter (a particle diameter in a region having a relatively high frequency in a particle size distribution) of each component powder used as the raw material powder is as described below.

<Fe and Cu Components>

Cu partially diffusion-alloyed powder (Cu content: 25 mass %): a range of from 106 μm to 150 μm Cu partially diffusion-alloyed powder (Cu content: 10 mass %)

Fe powder: a range of from 106 μm to 150 μm

Cu powder: 45 μm or less

<Components other than Fe and Cu>

C powder: 50 μm or less

Other powders (e.g., a solid lubricant and a mold release agent)

The raw material powder was prepared by mixing the component powders so as to give a blend composition as shown in Table 1. Next, the raw material powder was compressed under pressure to obtain a molded body in the form of a circular pipe measuring 10.5 mm in outer diameter, 5.0 mm in inner diameter, and 45.5 mm in length. During the compression under pressure, a molding pressure was appropriately selected. Thus, the density of the molded body was adjusted as shown in Table 2. Next, the molded body was sintered in a nitrogen gas atmosphere at a temperature of 1,127° C. for 30 minutes to obtain a sintered body. Then, the sintered body was subjected to cutting work. Thus, a valve guide measuring 10.3 mm in outer diameter, 5.5 mm in inner diameter, and 43.5 mm in length was obtained. The Cu content and the C content in each of the valve guides of Experimental Examples are shown in Table 2. The "Cu content in valve guide" shown in Table 2 is a value corresponding to the "Content of Cu component in raw material powder" shown in Table 1.

2. Measurement of Density

The density of the molded body before sintering treatment was measured in accordance with JIS Z 2501. The results are shown in Table 2.

3. Measurement of Pore Area Ratio

A cross section obtained by cutting the valve guide in a direction perpendicular to an axial direction was photographed with a laser microscope (HYBIRD L3 manufactured by Lasertec Corporation) at a magnification of 20 times. Next, the obtained image data was subjected to binarization treatment to determine the ratio of the area of pores with respect to the total area of the observation field. Thus, a pore area ratio was determined. The results are shown in Table 2.

4. Measurement of Cu Area Ratio

Photographing was performed in the same manner as in the measurement of the pore area ratio, and the image data of a cross section of the valve guide was subjected to binarization treatment. At this time, brightness at the time of photographing was changed from that in the measurement of the pore area ratio so that a Cu phase and a portion other than the Cu phase were able to be distinguished from each other at the time of binarization treatment. Then, the ratio of the area of the Cu phase with respect to the total area of the observation field was determined based on the image data subjected to the binarization treatment. Thus, a Cu area ratio was determined. The results are shown in Table 2.

5. Measurement of Thermal Conductivity

The thermal conductivity of the valve guide was measured by a laser flash method. The thermal conductivity was measured for a disc-shaped test piece (diameter: 10 mm, thickness: 2 mm) produced on the same production conditions as the valve guide of each Experimental Example with a vertical thermodilatometer (model DL-7000) manufactured by Shinku-riko Inc. (current company name: Advance Riko, Inc.). The thermal conductivity was measured for a time period from the start of laser irradiation until heat was transferred to a back surface of the test piece, and was calculated based on the thickness of the test piece. The results are shown in Table 2.

6. Measurement of Wear Amount

A valve (stem outer diameter: 5.48 mm, material: corresponding to SUH 35) was inserted into a hole of the valve guide. Next, while a lower end surface of the valve was heated with a gas burner so that the temperature of an outer peripheral surface of the valve guide on a lower end side (combustion chamber side) was 300° C., a vicinity of a middle portion of the valve guide in an axial direction was water cooled, and further, a pressing load of 70 N was applied to a side surface of the valve on a lower end side in a direction perpendicular to an axial direction of the valve. In addition, a lubricating oil (engine oil: corresponding to 0W-20) was dropped at 0.4 cc/hr from an upper end side of the valve guide. Under the state, the valve was reciprocated at 3,000 times/min for 4 hours while a stem rotation number was set to 0. Air was adopted as a test atmosphere. After the completion of the test, the inner diameters of the valve guide on the upper end side, in the middle portion, and on the lower end side in a direction parallel to the direction in which the pressing load was applied were measured. Based on change amounts in inner diameters of the valve guide on the upper end side, in the middle portion, and on the lower end side before and after the test, wear amounts at the respective positions were measured. Then, the average value of the wear amounts at these three positions was determined. The results are shown in Table 2.

7. Measurement of Hardness

As the hardness of a valve seat, a test piece after sintering was measured with a Rockwell hardness machine (model HR-100) manufactured by Mitutoyo Corporation. The hardness was measured at four positions for each test piece, and the average value thereof was determined.

TABLE 1

| | Blend composition of raw material powder (mass %) | | | | | | Content of Cu component in raw material powder (mass %) | Relative ratio of Cu component in raw material powder (%) | |
|---|---|---|---|---|---|---|---|---|---|
| | Fe component and Cu component | | | | Other components | | | | |
| | Cu partially diffusion-alloyed powder (Cu content: 25 mass %) | Cu partially diffusion-alloyed powder (Cu content: 10 mass %) | Fe powder | Cu powder | C powder | Other powders | | Ratio of Cu amount derived from Cu partially diffusion-alloyed powder | Ratio of Cu amount derived from Cu powder |
| Experimental Example A1 | 0.00 | 94.30 | 0.00 | 2.60 | 1.00 | Balance | 12.0 | 78.4 | 21.6 |
| Experimental Example A2 | 0.00 | 91.00 | 0.00 | 5.90 | 1.00 | Balance | 15.0 | 60.7 | 39.3 |
| Experimental Example A3 | 96.90 | 0.00 | 0.00 | 0.00 | 1.00 | Balance | 24.2 | 100.0 | 0.0 |
| Experimental Example A31 | 96.90 | 0.00 | 0.00 | 0.00 | 1.00 | Balance | 24.2 | 100.0 | 0.0 |
| Experimental Example A32 | 96.90 | 0.00 | 0.00 | 0.00 | 1.00 | Balance | 24.2 | 100.0 | 0.0 |
| Experimental Example A33 | 96.90 | 0.00 | 0.00 | 0.00 | 0.80 | Balance | 24.2 | 100.0 | 0.0 |
| Experimental Example A34 | 96.90 | 0.00 | 0.00 | 0.00 | 1.20 | Balance | 24.2 | 100.0 | 0.0 |
| Experimental Example A4 | 82.50 | 0.00 | 0.00 | 14.40 | 1.00 | Balance | 35.0 | 58.9 | 41.1 |
| Experimental Example A35 | 60.00 | 0.00 | 29.77 | 9.23 | 1.00 | Balance | 24.2 | 61.9 | 38.1 |
| Experimental Example B1 | 0.00 | 0.00 | 88.90 | 8.00 | 1.00 | Balance | 8.0 | 0.0 | 100.0 |
| Experimental Example B2 | 0.00 | 0.00 | 81.90 | 15.00 | 1.00 | Balance | 15.0 | 0.0 | 100.0 |
| Experimental Example B3 | 0.00 | 0.00 | 71.90 | 25.00 | 1.00 | Balance | 25.0 | 0.0 | 100.0 |
| Experimental Example B4 | 0.00 | 0.00 | 61.90 | 35.00 | 1.00 | Balance | 35.0 | 0.0 | 100.0 |
| Experimental Example A5 | 62.50 | 0.00 | 0.00 | 34.40 | 1.00 | Balance | 50.0 | 31.2 | 68.8 |

TABLE 2

| | Molded body | Valve guide | | | | | | |
|---|---|---|---|---|---|---|---|---|
| | before sintering Density ($g/cm^3$) | Cu content (mass %) | C content (mass %) | Pore area ratio (%) | Cu area ratio (%) | Thermal conductivity (W/m · K) | Wear amount (μm) | Hardness HRB |
| Experimental Example A1 | 6.85 | 12.0 | 1.0 | 4.2 | 13.1 | 29.3 | 22 | — |
| Experimental Example A2 | 6.85 | 15.0 | 1.0 | 4.5 | 15.7 | 34.5 | 26 | — |
| Experimental Example A3 | 6.85 | 24.2 | 1.0 | 7.0 | 24.2 | 52.0 | 40 | 68.8 |
| Experimental ExampleA31 | 6.75 | 24.2 | 1.0 | 11.5 | 23.3 | 51.6 | 39 | — |
| Experimental ExampleA32 | 6.95 | 24.2 | 1.0 | 7.3 | 22.3 | 52.4 | 41 | — |
| Experimental ExampleA33 | 6.85 | 24.2 | 0.8 | 9.4 | 23.2 | 52.0 | 46 | — |
| Experimental ExampleA34 | 6.85 | 24.2 | 1.2 | 9.3 | 24.0 | 52.0 | 34 | — |
| Experimental Example A4 | 6.85 | 35.0 | 1.0 | 3.6 | 33.8 | 56.7 | 63 | 68.9 |
| Experimental ExampleA35 | 6.85 | 24.2 | 1.0 | 3.8 | — | — | — | 71.0 |
| Experimental Example B1 | 6.85 | 8.0 | 1.0 | 3.3 | 9.7 | 25.7 | 9 | 82.4 |
| Experimental Example B2 | 6.85 | 15.0 | 1.0 | 2.9 | 10.5 | 26.2 | 38 | 78.8 |
| Experimental Example B3 | 6.85 | 25.0 | 1.0 | 3.3 | 26.2 | 55.1 | 70 | 80.6 |
| Experimental Example B4 | 6.85 | 35.0 | 1.0 | 2.4 | 40.3 | 61.3 | 115 | 68.4 |
| Experimental Example A5 | 6.85 | 50.0 | 1.0 | 2.3 | 48.1 | 63.5 | 345 | 55.0 |

*1 The pore area ratio of Experimental Example A3 is an average value of the pore area ratios of three samples (the values of the samples are 9.4, 3.7, and 8.0)

*2 The pore area ratio of Experimental Example A4 is an average value of the pore area ratios of three samples (the values of the samples are 3.6 and 3.5)

*3 The pore area ratio of Experimental Example B3 is an average value of the pore area ratios of three samples (the values of the samples are 2.7 and 3.9)

Figure 2:
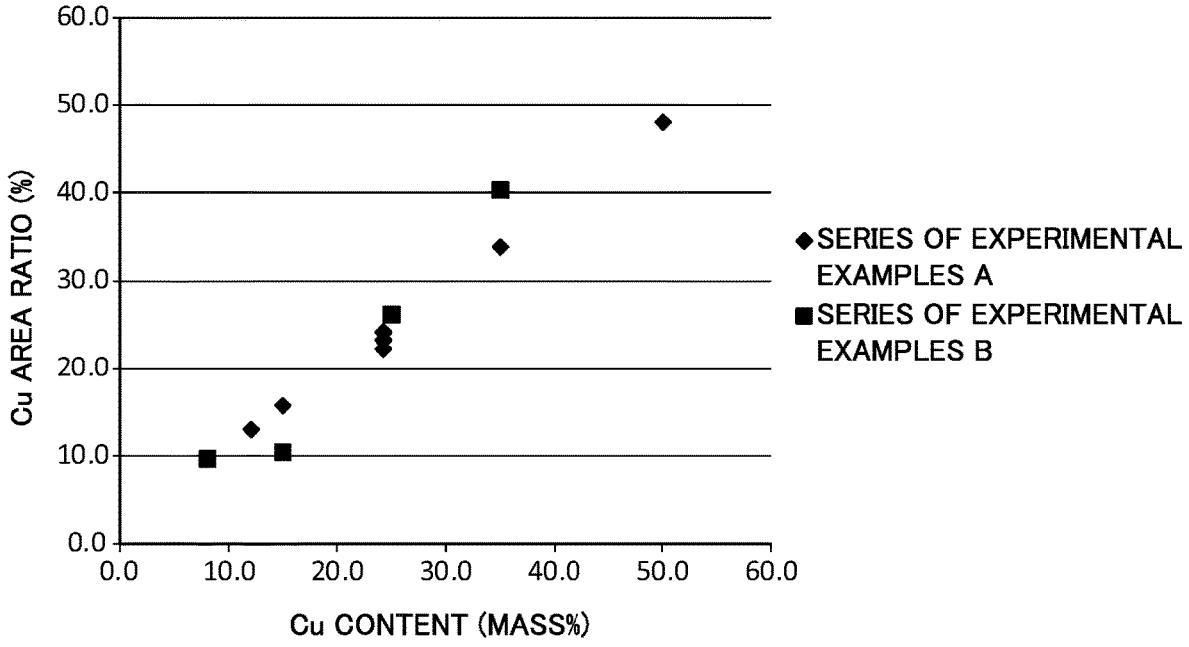
FIG. 2 is a graph for showing a change in Cu area ratio (%) with respect to a Cu content (mass %).
Figure 3:
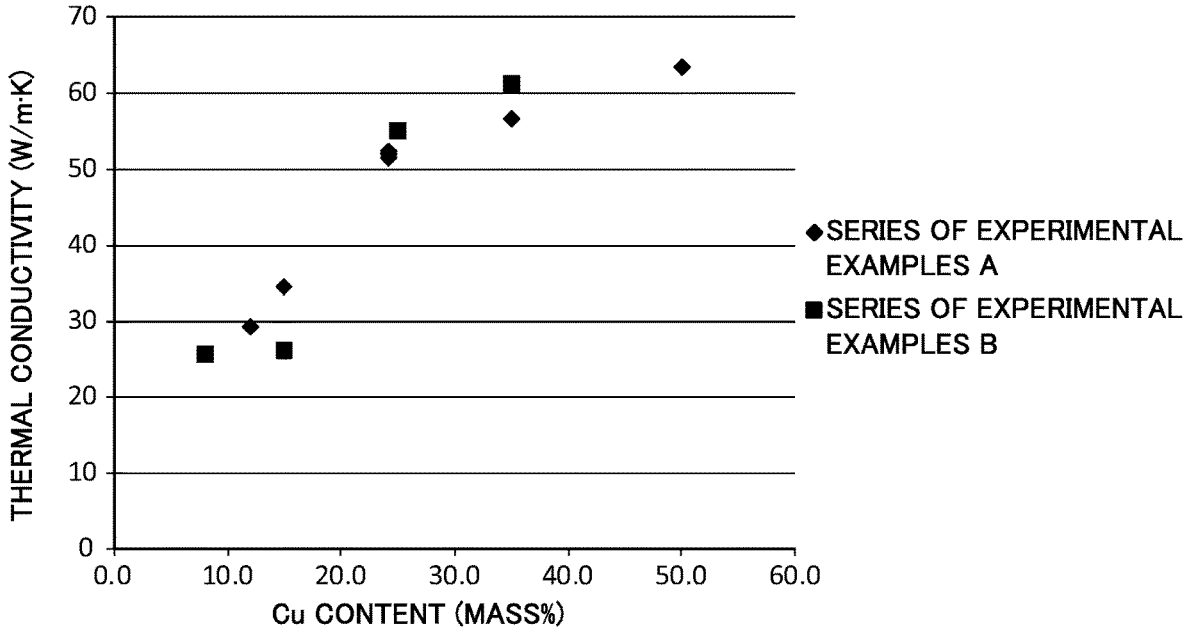
FIG. 3 is a graph for showing a change in thermal conductivity (W/m·K) with respect to a Cu content (mass %).
Figure 4:
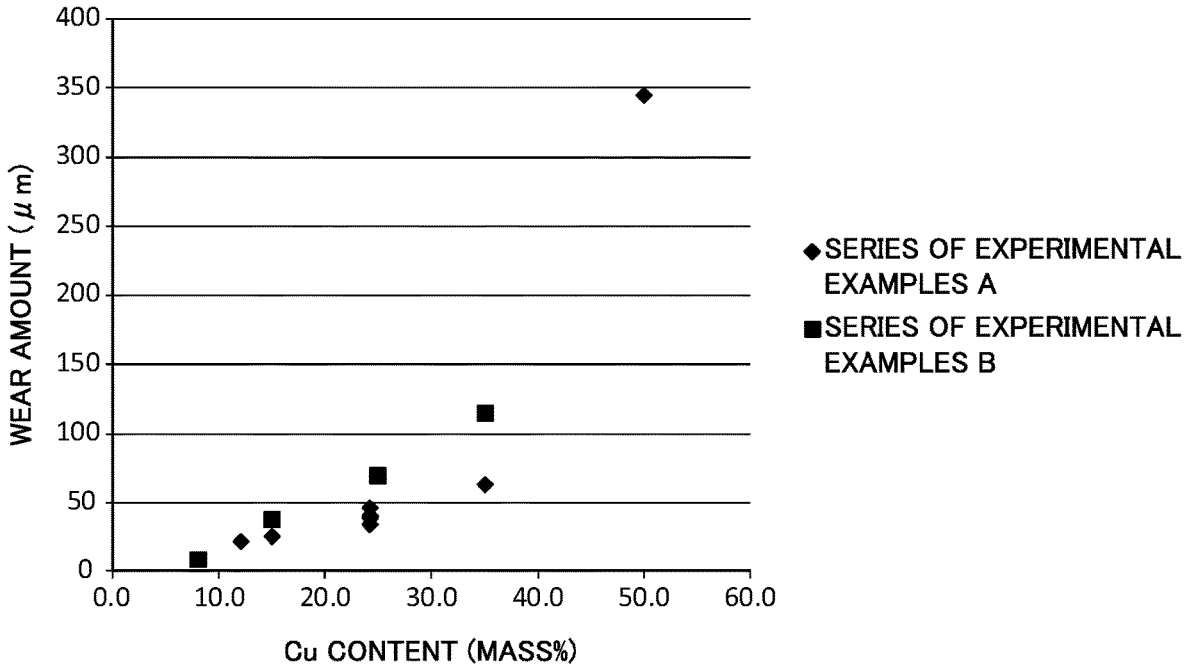
FIG. 4 is a graph for showing a change in wear amount (μm) with respect to a Cu content (mass %).
Figure 5:
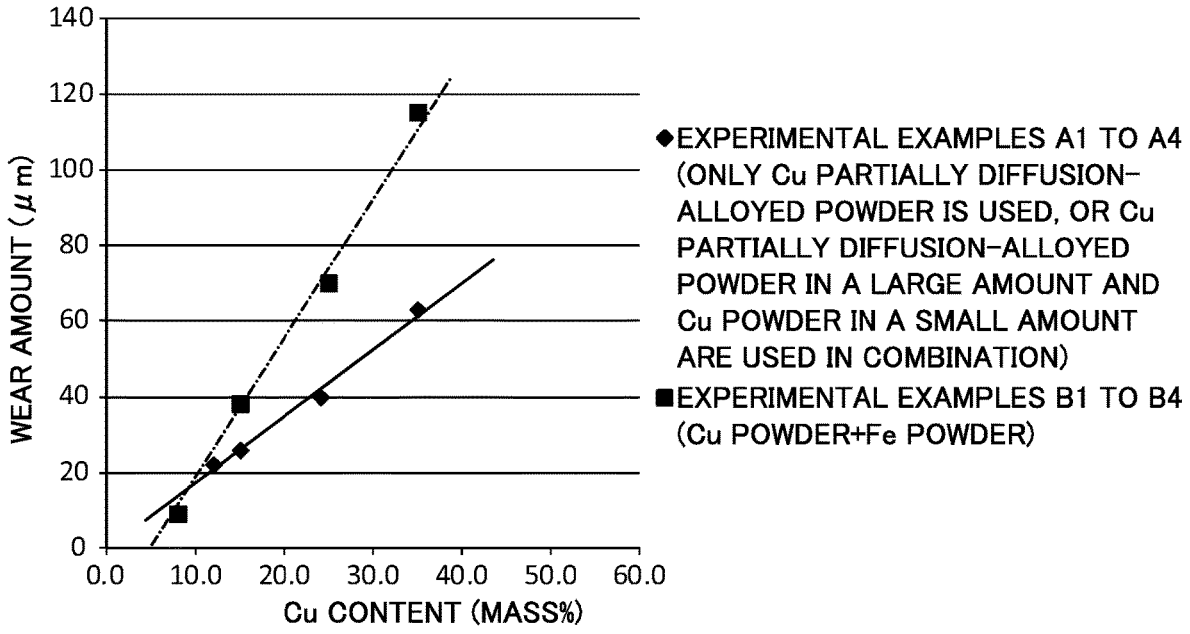
FIG. 5 is a graph for showing a change in wear amount (μm) with respect to a Cu content (mass %) in the cases of Experimental Examples A1, A2, A3, A4, B1, B2, B3, and B4, in each of which a Cu content falls within a range of 40 mass % or less.
Figure 6:
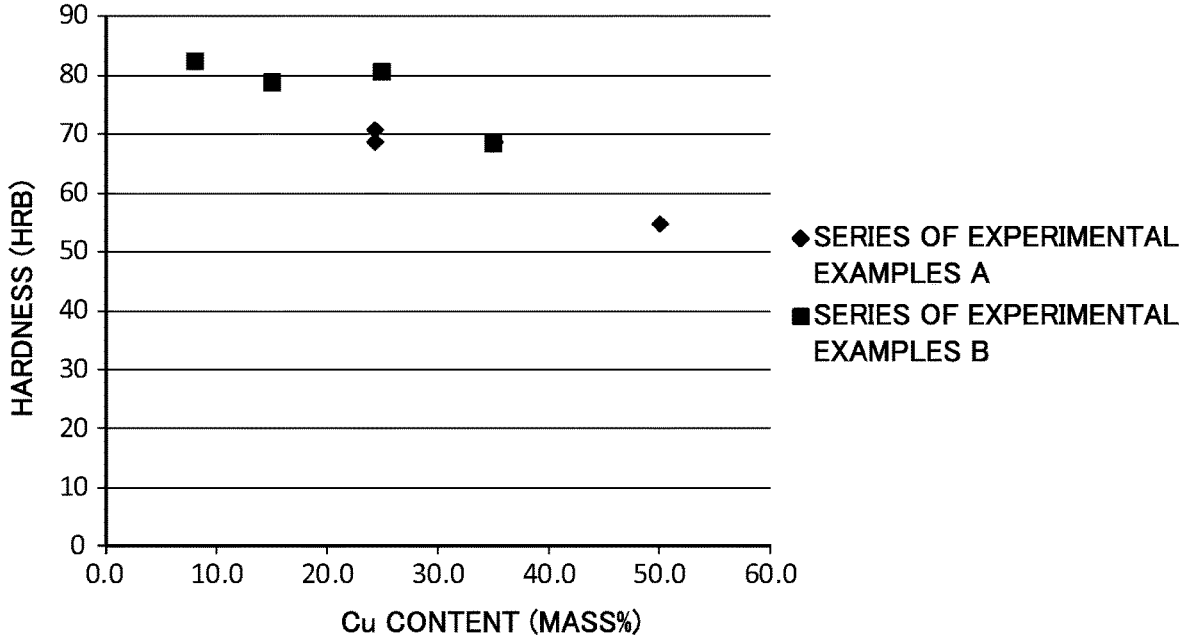
FIG. 6 is a graph for showing a change in hardness (HRB) with respect to a Cu content (mass %).

8. Changes in Various Physical Property Values and Characteristic Values with Respect to Cu Content Graphs for showing changes in various physical property values and characteristic values with respect to a Cu content created based on Table 1 and Table 2 are shown in FIG. 1 to FIG. 6. Herein, FIG. 1 is a graph for showing a change in pore area ratio (%) with respect to a Cu content (mass %), FIG. 2 is a graph for showing a change in Cu area ratio (%) with respect to a Cu content (mass %), FIG. 3 is a graph for showing a change in thermal conductivity (W/m·K) with respect to a Cu content (mass %), FIG. 4 is a graph for showing a change in wear amount (μm) with respect to a Cu content (mass %), FIG. 5 is a graph for showing a change in wear amount (μm) with respect to a Cu content (mass %) in the cases of Experimental Examples A1, A2, A3, A4, B1, B2, B3, and B4, in each of which the Cu content falls within a range of 40 mass % or less, and FIG. 6 is a graph for showing a change in hardness (HRB) with respect to a Cu content (mass %).

From FIG. 2, FIG. 3, and FIG. 6, with regard to changes in Cu area ratio, thermal conductivity, and hardness with respect to a Cu content, there is no remarkably significant difference between the valve guides (a series of Experimental Examples A) each produced by using at least the Cu partially diffusion-alloyed powder as the Cu component and the Fe component and the valve guides (a series of Experimental Examples B) each produced by using only the Cu powder and Fe powder as the Cu component and the Fe component.

In addition, with reference to FIG. 1, it also seems that, with regard to a change in pore area ratio with respect to a Cu content, the series of Experimental Examples A as a whole tends to exhibit a higher pore area ratio at the same Cu content than the series of Experimental Examples B. However, as shown in *1 and *3 at the bottom of Table 2, even the valve guide of the same Experimental Example is largely varied in pore area ratio depending on measurement samples. From this, it is hard to say that such a clear significant difference as to be able to be quantitatively and specifically specified by some kind of numerical value or parameter is present between the series of Experimental Examples A and the series of Experimental Examples B. However, it is apparent from FIG. 1 that the valve guides (the series of Experimental Examples A) each produced by using the Cu partially diffusion-alloyed powder or appropriately combining the Cu partially diffusion-alloyed powder and the Fe powder and/or the Cu powder as a whole tend to exhibit a higher pore area ratio than the valve guides (the series of Experimental Examples B) each produced by using the Cu powder and the Fe powder. Therefore, it is presumed that the valve guides each produced by using the Cu partially diffusion-alloyed powder as a main component of the raw material powder each have a higher oil retention property than the valve guides each produced by using the Cu powder and the Fe powder, and lead to improvement in wear resistance.

Meanwhile, with reference to FIG. 4, in each of the series of Experimental Examples A and the series of Experimental Examples B, the wear amount is increased with an increase in Cu content. Particularly when the Cu content exceeds 40 mass %, the wear amount is drastically increased in the series of Experimental Examples A. Herein, further with reference to FIG. 3, it is found that the improvement in thermal conductivity tends to be saturated when the Cu content exceeds 40 mass %. Based on those points, the case in which the Cu content exceeds 40 mass % is judged as being inferior to the case in which the Cu content is 40 mass % or less from the viewpoint of comprehensively improving the wear resistance and the thermal conductivity because, when the Cu content exceeds 40 mass %, the improvement in thermal conductivity is saturated and only the wear amount is drastically increased. Based on this point, FIG. 5 is shown in order to examine a change in wear amount (μm) with respect to a Cu content (mass %) in the case in which the Cu content falls within a range of 40 mass % or less.

Of Experimental Examples shown in Table 1 and Table 2, FIG. 5 is a graph for Experimental Examples produced on the same production conditions except that the combination and blending ratio of metal powders of the Cu component and the Fe component in the raw material powder used for production of the valve guide were changed. As apparent from FIG. 5, in each of Experimental Examples A1 to A4 and Experimental Examples B1 to B4, the wear amount is linearly increased with an increase in Cu content. In addition, the increase rate of the wear amount with respect to the Cu content (gradient of each of the two lines of FIG. 5) is remarkably higher in Experimental Examples B1 to B4 than in Experimental Examples A1 to A4. Moreover, when the Cu content is 14 mass % or more, it is apparent that the wear amount at the same Cu content is smaller in the series of Experimental Examples A than in the series of Experimental Examples B, and the degree of divergence in wear amount with an increase in Cu content between these series is also increased.

Herein, of Experimental Examples A1 to A4, Experimental Examples A2 to A4 correspond to the condition (1) of having a Cu content falling within a range of from 14 mass % to 40 mass %. Moreover, when Experimental Examples A2 to A4 are compared to Experimental Examples B2 to B4 corresponding thereto in terms of Cu content, Experimental Examples A2 to A4 each have a feature of being produced by using the Cu partially diffusion-alloyed powder as main raw material powder, and (2) each have a ratio of the Cu component derived from the Cu partially diffusion-alloyed powder with respect to the Cu component contained in the raw material powder of 45% or more. That is, the valve guides each produced under the conditions satisfying the above-mentioned conditions (1) and (2) can be significantly improved in wear resistance while ensuring comparable thermal conductivity as compared to the valve guides each produced by using only the Fe powder and the Cu powder as supply sources for the Fe component and the Cu component in the raw material powder, respectively.

From the graph shown in FIG. 5, it can be understood that the improvement in wear resistance has an extremely strong correlation with the use of the Cu partially diffusion-alloyed powder as the raw material powder at the time of production of the valve guide.

Figure 7A:
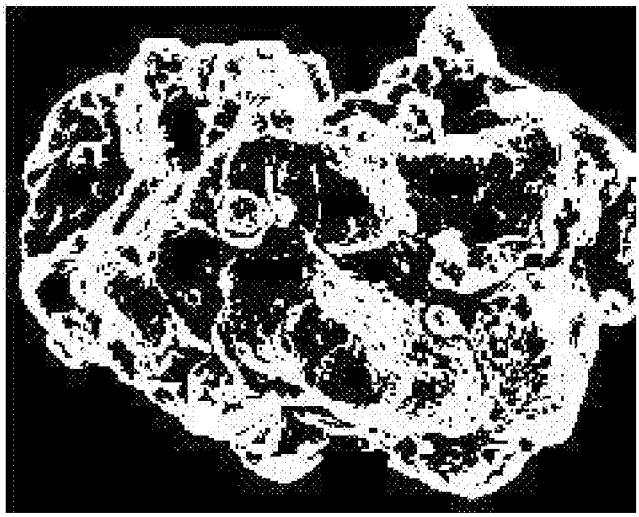
FIG. 7A and 7B are each a photograph for showing an example of a Cu partially diffusion-alloyed powder (Cu content: 25 mass %). Herein.
Figure 7B:
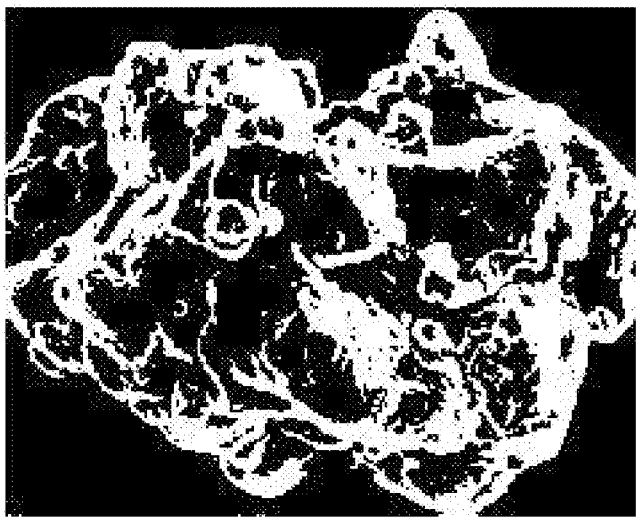

9. Observation of Cu Partially Diffusion-Alloyed Powder with Electron Microscope FIG. 7A and 7B are each a photograph for showing an example of the Cu partially diffusion-alloyed powder (Cu content: 25 mass %). Herein, FIG. 7A is an electron micrograph for showing an appearance configuration of the Cu partially diffusion-alloyed powder, and FIG. 7B is a composition map (EDS analysis map) for showing distribution of Cu on a surface of the Cu partially diffusion-alloyed powder shown in FIG. 7A. While the following cannot be distinguished in FIG. 7B itself attached to the present application because of resolution and black and white presentation, it is confirmed on the original data of FIG. 7B that Cu is present in a dispersed manner as fine dotted regions on a surface of core iron powder other than as a region in which Cu is unevenly distributed. From those facts, it can be grasped that Cu is bonded to the core iron powder through diffusion.

10. Sectional Observation of Molded Body Before Sintering

Figure 8A:
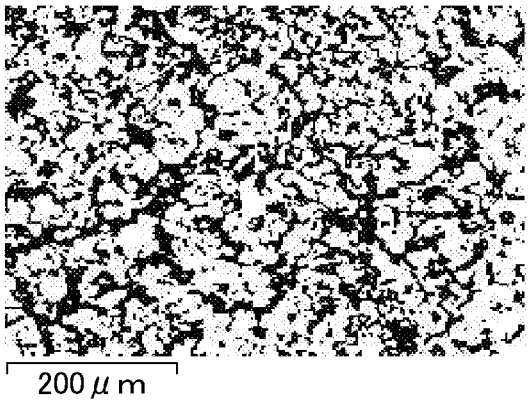
FIG. 8A to 8F are each an image for showing an example of a cross section of a sample after compression under pressure of raw material powder and before sintering (molded body before sintering). Herein.
Figure 8B:
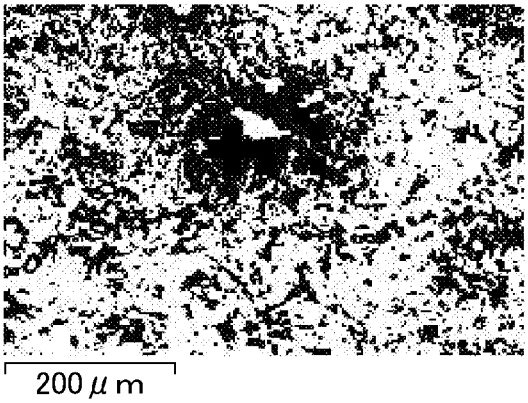
Figure 8C:
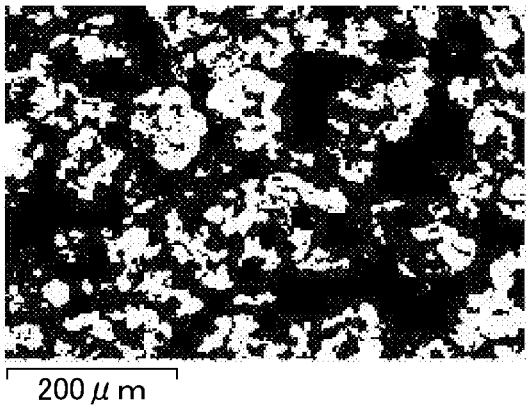
Figure 8D:
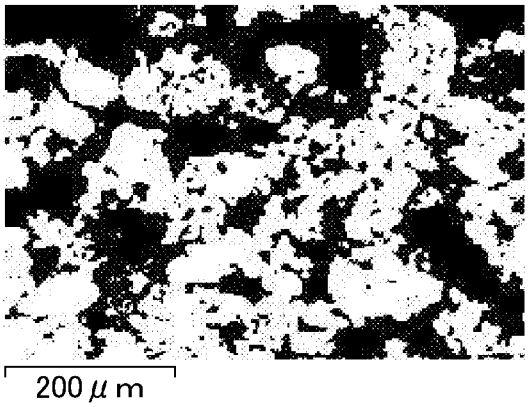
Figure 8E:
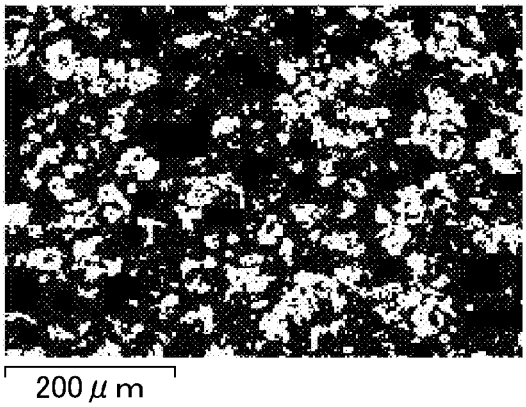
Figure 8F:
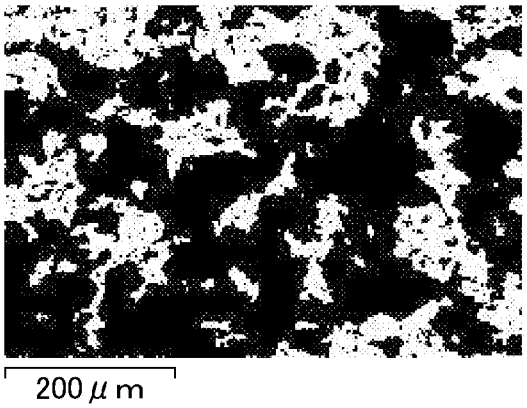

FIG. 8A and 8F are each an image for showing an example of a cross section of a sample after compression under pressure of raw material powder and before sintering (molded body before sintering). Herein, out of the six images shown in FIG. 8A to 8F, the three images on the left column side (FIG. 8A, FIG. 8C, and FIG. 8E) are each an example of an image of the sample of Experimental Example A3 ((1) the content of the Cu component in the raw material powder: 25 mass %, (2) the ratio of the Cu component derived from the Cu partially diffusion-alloyed powder with respect to the Cu component contained in the raw material powder: 100%), and the three images on the right column side (FIG. 8B, FIG. 8D, and FIG. 8F) are each an example of the sample of Experimental Example B3 ((1) the content of the Cu component in the raw material powder: 25 mass %, (2) the ratio of the Cu component derived from the Cu partially diffusion-alloyed powder with respect to the Cu component contained in the raw material powder: 0%).

In addition, of the six images shown in FIG. 8A to 8F, the upper two images (FIG. 8A and FIG. 8B) are electron micrographs (SEM images), the middle two images (FIG. 8C and FIG. 8D) are composition images of an Fe element corresponding to the upper electron micrographs, and the lower two images (FIG. 8E and FIG. 8F) are composition images of a Cu element corresponding to the upper electron micrographs. In each of the middle composition images of an Fe element, out of regions binarized into white and black, the white region corresponds to Fe. In each of the lower composition images of a Cu element, out of regions binarized into white and black, the white region corresponds to Cu.

While Experimental Example A3 and Experimental Example B3 shown in FIG. 8A to 8F are the same in the total Cu content in the raw material powder, these Experimental Examples largely differ from each other as to whether the valve guide is produced by using the Cu partially diffusion-alloyed powder or by using the Cu powder and the Fe powder. Moreover, in particular, with reference to FIG. 8E and FIG. 8F, it is found that Cu tends to be distributed less unevenly and dispersed more uniformly in the matrix in Experimental Example A3 than in Experimental Example B3. In addition, it is considered that the difference in degree of uneven distribution of Cu does not depend on a difference in Cu area ratio and a difference in total Cu content in the raw material powder. This is because there is no significant difference in Cu area ratio with respect to a Cu content between the series of Experimental Examples A and the series of Experimental Examples B as shown in FIG. 2, and Experimental Example A3 and Experimental Example B3 are the same in total Cu content in the raw material powder. Accordingly, it is considered that the difference in degree of uneven distribution of Cu largely depends on whether or not the Cu partially diffusion-alloyed powder is used as a main component for the Fe component and the Cu component in the raw material powder.

Moreover, it is presumed that the result shown in FIG. 5 that the series of Experimental Examples A exhibits more excellent wear resistance than the series of Experimental Examples B with an increase in Cu content is also attributed to the difference in degree of uneven distribution of Cu in the matrix. The reason for this is as described below. The hardness is reduced more as the Cu content is increased more as shown in FIG. 6, and hence it is considered that local wear is more liable to be promoted in the series of Experimental Examples B, in which the degree of uneven distribution of Cu in the matrix is higher. Therefore, in order to quantitatively and specifically grasp the uneven distribution of Cu as shown in FIG. 8E and FIG. 8F, the inventors of the present invention have made investigations on quantification of the distribution by some kind of numerical value, but cannot found a specific measure.

The invention claimed is:

1. A method of producing a valve guide made of an iron-based sintered alloy, the method comprising the steps of:

molding raw material powder including at least one kind of calcium compound selected from the group consisting of calcium carbonate and calcium sulfide, and diffusion-alloyed powder consisting of core iron powder and Cu bonded to the core iron powder through diffusion to obtain a molded body, and sintering the molded body, to thereby produce a valve guide made of an iron-based sintered alloy, wherein the sintered alloy includes $MoS_2$, and the molded body having a density of about 6.55 g/cm$^3$ to about 7.15 g/cm$^3$, (1) the raw material powder having a content of a Cu component falling within a range of from 24.2 mass % to 35 mass %, (2) a thermal conductivity at 400° C. of about 40 W/mK to about 60 W/mK, (3) a ratio of a Cu component derived from the diffusion-alloyed powder consisting of core iron powder and Cu bonded to the core iron powder through diffusion with respect to the Cu component contained in the raw material powder being 45% or more;

wherein the valve guide has a structure including pores and a Cu phase, and a pore area ratio of the pores is 3% or more and 15% or less and a Cu area ratio of the Cu phase is from 11% to 36%.

2. A method of producing a valve guide made of an iron-based sintered alloy, the method comprising the steps of:

molding raw material powder including a diffusion-alloyed powder consisting of core iron powder and Cu bonded to the core iron powder through diffusion to obtain a molded body, and sintering the molded body, to thereby produce a valve guide made of an iron-based sintered alloy, (1) the raw material powder having a content of a Cu component falling within a range of from 24.2 mass % to 35 mass %, (2) a ratio of a Cu component derived from the diffusion-alloyed powder consisting of core iron powder and Cu bonded to the core iron powder through diffusion with respect to the Cu component contained in the raw material powder being 45% or more; and wherein the valve guide has a thermal conductivity at 400° C. of about 50 W/m·K to about 60 W/m·K.

3. A method of producing a valve guide made of an iron-based sintered alloy, the method comprising the steps of:

molding raw material powder including a diffusion-alloyed powder consisting of core iron powder and Cu bonded to the core iron powder through diffusion to obtain a molded body, and sintering the molded body, to thereby produce a valve guide made of an iron-based sintered alloy, (1) the raw material powder having a content of a Cu component falling within a range of from 24.2 mass % to 35 mass %, (2) a ratio of a Cu component derived from the diffusion-alloyed powder consisting of core iron powder and Cu bonded to the core iron powder through diffusion with respect to the Cu component contained in the raw material powder being 45% or more; and wherein the valve guide has a thermal conductivity at 400° C. of about 50 W/m·K to about 55 W/m·K.

4. A method of producing a valve guide made of an iron-based sintered alloy, the method comprising the steps of:

molding raw material powder including diffusion-alloyed powder consisting of core iron powder and Cu bonded to the core iron powder through diffusion to obtain a molded body, and sintering the molded body, to thereby produce a valve guide made of an iron-based sintered alloy, (1) the raw material powder having a content of a Cu component falling within a range of from 24.2 mass % to 35 mass %, (2) a ratio of a Cu component derived from the diffusion-alloyed powder consisting of core iron powder and Cu bonded to the core iron powder through diffusion with respect to the Cu component contained in the raw material powder being 45% or more; and wherein the valve guide has a thermal conductivity at 400° C. of about 40 W/m·K to about 60 W/m·K.

5. The method of producing a valve guide made of an iron-based sintered alloy according to claim 4, wherein the valve guide has a thermal conductivity at 400° C. of about 50 W/m·K to about 60 W/m·K.

6. The method of producing a valve guide made of an iron-based sintered alloy according to claim 4, wherein the valve guide has a thermal conductivity at 400° C. of about 50 W/m·K to about 55 W/m·K.

* * * * *